United States Patent [19]

Daniel et al.

[11] Patent Number: 4,872,416

[45] Date of Patent: Oct. 10, 1989

[54] ELASTOMERIC CLEANER FOR GROOVED ROTATING ROLLS

[75] Inventors: Vernon T. Daniel, Oak Ridge; Jessie Gettliffe, Greensboro; Tina V. Lorenzo, Jamestown, all of N.C.

[73] Assignee: Burlington Industries, Inc., Greensboro, N.C.

[21] Appl. No.: 818,769

[22] Filed: Jan. 14, 1986

[51] Int. Cl.[4] ..... B05C 1/08

[52] U.S. Cl. ..... 118/203; 15/256.51

[58] Field of Search ..... 118/104, 203, 234; 427/428; 15/256.5 X

[56] References Cited

U.S. PATENT DOCUMENTS

| | | | |
|---|---|---|---|
| 2,599,947 | 6/1952 | Sherman et al. | 118/104 |
| 2,797,661 | 7/1957 | Leaming | 118/694 |
| 3,378,876 | 4/1968 | Sisson | 15/256.51 |
| 4,300,476 | 11/1981 | Jurascheck et al. | 118/262 |
| 4,501,486 | 2/1985 | Landa | 15/256.51 X |
| 4,540,610 | 9/1985 | Conklin et al. | 427/434.5 |

*Primary Examiner*—Shrive Beck
*Assistant Examiner*—Alain Bashore
*Attorney, Agent, or Firm*—Nixon & Vanderhye

[57] ABSTRACT

An apparatus and method effect cleaning of a grooved applicator cylinder which applies molten size to textile strands, such as spun yarns. A plurality of holding blocks have quadrate-shaped channels formed in one end thereof, and a circular cross-section elongated elastomeric material cord (e.g., silicone rubber having a Durometer of about 50–75) is frictionally received within the channel. The position of the holding blocks with respect to a housing may be individually adjusted utilizing a cam slide having a slanted surface which engages an adjustment screw, tightening of the adjustment screw sliding the holding block toward the cylinder. The elastomeric material of the cord deforms to essentially completely fill the grooves and to wipe unused size, lint and the like from the grooves and adjacent lands, including the bottoms of the grooves, to effect cleaning. The housing is beveled to facilitate flow of removed size thereover.

4 Claims, 2 Drawing Sheets

FIG. 1
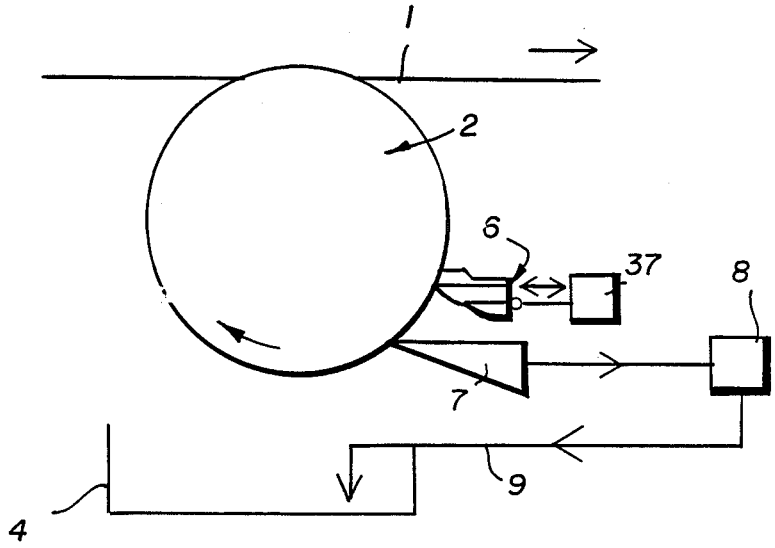
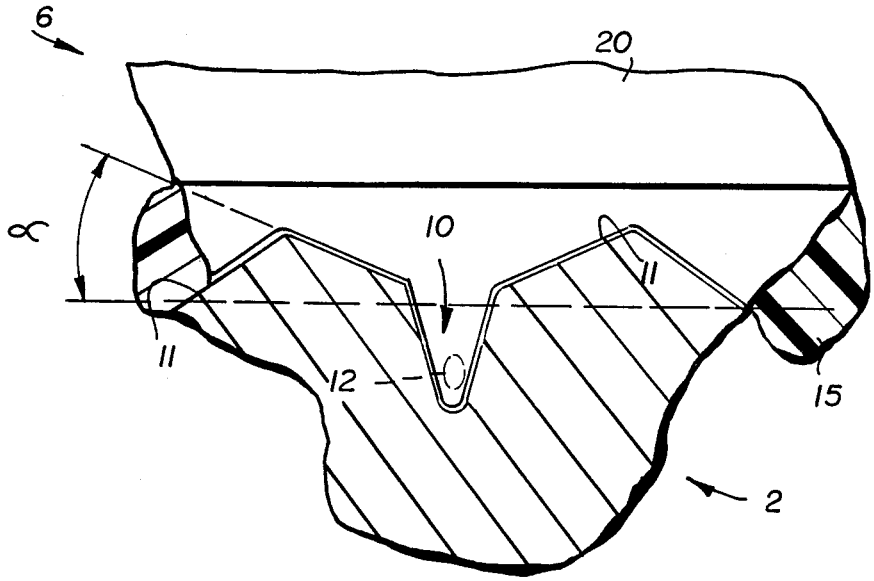
FIG. 4

ELASTOMERIC CLEANER FOR GROOVED ROTATING ROLLS

BACKGROUND AND SUMMARY OF THE INVENTION

In the application of size to textile strands, such as spun yarns, apparatus and procedures have been developed to effect application of hot melt size or the like, to the textile strands. The apparatus that has been developed includes methods and procedures which have been developed utilizing an applicator cylinder having a peripheral closed surface defined by a plurality of alternating grooves and lands extending circumferentially about the peripheral closed surface. Typical of such apparatus is that illustrated in U.S. Pat. No. 4,540,610 (the disclosure of which is hereby incorporated by reference herein). In order to effectively utilize such apparatus, a structure and procedure must be employed that efficiently effect cleaning of unused size, and collected lint, from the grooves and the lands, otherwise the system becomes contaminated, the grooves partially fill up, and the sizing operation ceases to be efficient.

A number of different structures and procedures have been employed in order to effect efficient groove cleaning, such as those disclosed in said U.S. Pat. No. 4,540,610 and in U.S. Pat. No. Re. 29,287. While such prior cleaning mechanisms have been reasonably effective, they have often not had the efficiency and cost effectiveness that are desired for commercial sizing operations.

According to the present invention, an apparatus and method are provided which do provide efficient and cost effective cleaning of the grooved applicator cylinder for applying melted sizing material to textile strands. The apparatus according to the present invention is eminently simple, comprising an elongated cord of elastomeric material, such as silicones or fluorosilicones having a Durometer hardness within the range of about 50–75, and preferably being circular in cross-section. The elastomeric material cord is disposed generally parallel to the axis of rotation of the cylinder, and is moved by a plurality of holding blocks into intimate contact with the grooves and lands on the cylinder circumference. Each holding block has a generally quadrate-shaped channel formed in a first end thereof which frictionally receives the elastomeric cord, and the position of each block with respect to a housing may be adjusted utilizing a cam slide having a slanted portion, and a screw threaded fastener which engages the holding block on the opposite end thereof from the channel.

The elastomeric material cord is deformed when it engages the surface of the applicator cylinder (or roller), and essentially completely mates with the grooves and the lands of the cylinder periphery, and is even effective to penetrate to the bottoms of the grooves. The cord thus effects wiping, and cleaning of the entire circumferential periphery of the cylinder including the bottoms of the grooves, and the lands, and does so in an efficient manner.

Pursuant to a method according to the present invention, textile strands are sized by passing them through the applicator cylinder grooves and cleaning of the cylinder peripheral surface is effected by forcing the elastomeric material cord into contact with that surface. Periodically, the elastomeric material cord is removed from the cylinder surface and is inspected to see if "fins" have set in the material. Once it is determined that such fins have set and the cord will not elastomerically recover to approximately its original circular cross-section, the elastomeric cord is removed merely by grasping it and stripping it from the channel. Then a new elastomer material cord is pressed into the channel and the cleaning operation can continue. The elastomeric material cord is inexpensive and it will be seen that it is extremely easy to utilize and replace.

It is the primary object of the present invention to provide a cost effective and efficient apparatus and method for cleaning an applicator cylinder, particularly one having a peripheral surface formed with alternating grooves and lands. This and other objects of the invention will become clear from an inspection of the detailed description of the invention and from the appended claims.

BRIEF DESCRIPTION OF THE DRAWINGS

FIG. 1 is a diagrammatic sectional end view of exemplary apparatus according to the present invention;

FIG. 4 is an end detail view, partly in cross-section and partly in elevation, schematically illustrating the cooperation between the elastomeric material cord and the applicator cylinder grooves and lands according to the present invention.

DETAILED DESCRIPTION OF THE DRAWINGS

Figure 3:
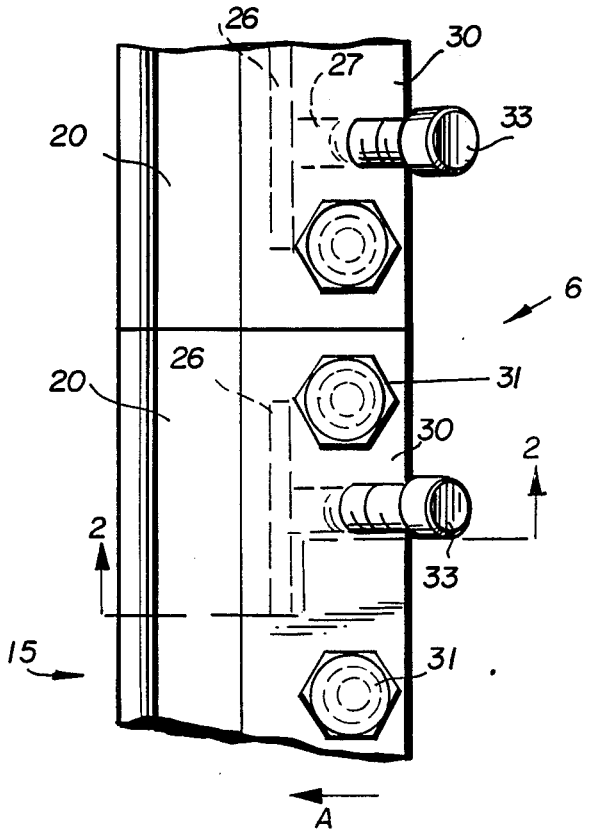
FIG. 3 is a partial top plan view of a cleaning mechanism of FIG. 2.

FIG. 1 schematically illustrates exemplary apparatus according to the invention, showing a sheet of warp yarns 1 passing across a limited arc of the deep circumferential grooves of heated applicator cylinder 2. The direction of the yarn travel is preferably as shown, i.e., it is in the same direction as the rotation of the cylinder, although it may be reversed. Molten size is applied to the surface of cylinder 2, and is forced into the grooves thereof, by any suitable means (not shown) such as illustrated in U.S. Pat. No. Re. 29,287 or U.S. Pat. No. 4,540,610.

Residual size still on the cylinder after the zone of yarn contact is thoroughly stripped from the cylinder by cleaning device 6, according to the present invention. The size thus removed flows down the face of the cleaning device into catching pan 7, which preferably has a filter on top of it to filter out lint. Alternatively, the melted size from pan 7 is passed (for instance pumped) to a filter 8, and from filter 8 is passed through a pipe 9 back to a trough 4 ultimately to be picked up by an applicator roll or the like, and supplied to the cylinder 2.

FIG. 4 illustrates an exemplary configuration of a portion of applicator cylinder 2, which includes sloping lands 11 which extend between deep circumferential grooves 10, the lands 11 preferably disposed at an angle $\alpha$ of about 8–12 degrees from the horizontal as shown in said U.S. Pat. No. 4,510,610. The applicator cylinder 2 is preferably made of stainless steel or aluminum. The grooves 10 have a depth greater than a given diameter of a textile strand 12 passing therethrough. As seen in FIG. 4, the strand 12 (such as spun yarn or the like) in passing through the grooves 10 removes a portion of the molten size therein. The roller 10 is heated to maintain the size in molten condition.

Figure 2:
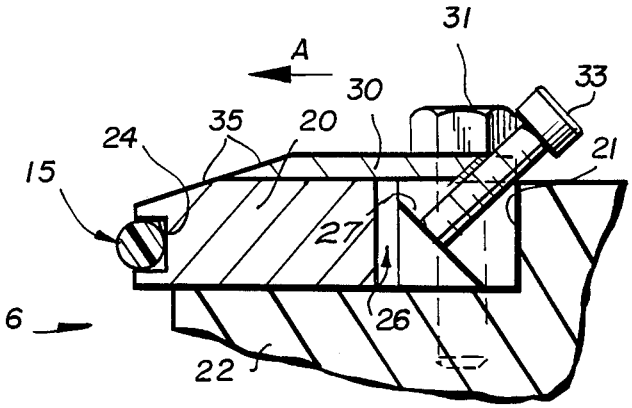
FIG. 2 is a side cross-sectional view of an exemplary cleaning mechanism according to the present invention, taken along the lines 2—2 of FIG. 3.

The cleaning means 6 according to the invention is shown in detail in FIGS. 2–4. The actual functional wiping component which effects removal of size from the cylinder 2 periphery comprises an elongated elastomeric material cord 15. This cord 15, which also may be referred to as a "rod" or "strip", is of any suitable elastomeric material with good resistance to heat and oil. Silicones and fluorosilicones have the desired elastomeric and resistance properties, and silicone cords with Durometer hardness in the range of about 50–75 (preferably 60–75) are particularly appropriate. These materials are inherently thermally and electrically non-conductive. As illustrated in the drawings, it is preferred that the original non-deformed configuration of the cord 15 be generally circular in cross-section and the cord have a diameter between about 0.125–0.375 inches (e.g., 0.25 inches). In any event, the properties of the cord 15 should be selected so that when it is pressed against the grooved peripheral circumference of the cylinder 2 with an appropriate force it deforms to essentially completely fill the grooves 10 and engage the entire circumferential periphery, including lands 11, of the cylinder 2 to provide a squeegee action which effectively wipes lint and surplus size from the grooves and the lands.

In order to properly hold the cord 15 in place—as illustrated in FIG. 4—against the grooved circumference of the cylinder 2, a holding means is provided, the holding means being most clearly illustrated in FIGS. 2 and 3. The holding means preferably comprises at least one, and preferably a plurality of adjacent holding blocks 20 which are mounted in a slot 21 or the like in a housing 22. The blocks 20 preferably comprise aluminum or other suitable metal, as does the housing 22. At a first end thereof, each of the blocks 20 has means defining a channel 24. As illustrated in FIG. 2, the channel 24 preferably is quadrate in section. Means are provided for holding the cord 15 in place in the channel 24, and preferably the means for maintaining the cord 15 in place consists of only frictional engagement between the elastomeric material cord 15 and the walls of the channel 24. In this way the cord 15 may be easily put in place in the channels 24, and readily removed therefrom.

Means are also provided for individually adjusting the positions of the blocks 20 with respect to the housing 22 to ensure that the cord 15 is in proper position with respect to the cylinder 2 along the entire length thereof. To this end, preferably there is provided associated with each block 20 a cam slide 26 which includes a surface portion 27 that is angled with respect to the dimension of adjustment A of the block 20. The block 20 is held in place in the slot 21 for sliding movement in dimension A by a hold down strip 30, which is held in place on the housing 22 by bolts 31 or like fasteners. The clamping force applied by the holddown strip 30 to the blocks 20 is adjustable by the degree that the bolts 31 are tightened. To effect movement of the blocks 20 an adjustment screw 33, which extends in screw threaded relationship with the strip 30 into contact with the surface 27, is rotated, clockwise rotation of the adjustment screw 33 resulting in movement of the block 20 with respect to the housing 22 so that the cord 15 moves away from the housing 22.

The side of the holding blocks and holddown strip facing the applicator 2 preferably has a bevel, as indicated by reference number 35, e.g., a bevel of about 20 degrees. This facilitates flow of removed size and lint thereover.

It will be seen that the blocks 20 holding cord 15 are generally in alignment (that is channels 24 thereof are generally in alignment) in the normal position, as illustrated in FIG. 3, but adjustment of the relative positions thereof may be made to take into account surface irregularities, or the like, of the applicator cylinder 2.

With reference to FIG. 1, it will be seen that the cleaning means 6 is preferably disposed at a four o'clock position with respect to the cylinder 2, although other suitable positions also may be utilized. Any type of conventional powered moving means, such as the linear actuator 37 schematically illustrated in FIG. 1, provides for movement of the housing 22 into contact with the grooved circumference of the cylinder 2. In normal use, the force applied by the actuator 37 should be sufficient to provide for complete wiping of size and lint from the grooves 10 and lands 11. This is best determined by visual inspection, the housing 22 being moved by actuator 37 into contact with the grooved circumference of the cylinder 2 and the force increased until the cord 15 wipes the applicator roll 2 lands 11 and grooves 10 clean and lint free including the bottoms of the grooves 10.

Figure 5:
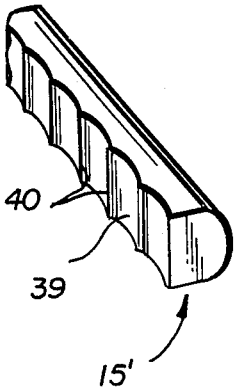
FIG. 5 is a perspective view of a part of an elastomeric cord according to the invention in which "fins" have set, so that the cord is ready for replacement.

Due to the elastomeric nature of the material forming the cord 15, when the cleaning means 6 is removed from operative association with the applicator cylinder 2, there will be no permanent deformation of the element 15, but rather it will elastomerically recover. However, after a certain period of use depending on size composition, temperature and the like, the cord 15 will be permanently deformed so that fins set in a face thereof. A cord in this condition is illustrated in FIG. 5 by reference numeral 15'. Note the face 39 thereof which has been against the grooved circumference of the roll 2, the face 39 having fins 40 set therein. When the cord reaches the condition illustrated by cord 15' in FIG. 5, the operator strips the cord from the channel 24, and force fits a new cord 15 into contact therewith.

Operation

The textile strands 1, 12 continuously pass through grooves 10 in the circumference of the applicator roll 2 picking up size supplied from source 4 as each strand (e.g., 12 in FIG. 4) passes through a groove 10. The size in the grooves 10 that is unused, and the lint that forms on the circumference of the applicator roll 2, are wiped clean at the four o'clock position by the cleaning means 6. The linear actuator 37 moves the housing 22 toward the grooved circumference of the roll 2 so that elastomeric material cord 15 deforms and assumes the configuration of the circumference to the roll 2, including the lands 11 and grooves 10 thereof. All unused size and all lint are squeegeed off of the roll 2 circumference and pass into pan 7 to be recycled.

If a force supplied by the actuator 37 is sufficient to effect good wiping over most of the axial length of the roll 2, but some portions are not being wiped clean, the holding blocks 20 associated with those portions are adjusted by rotating screws 33 clockwise, which causes a force to be applied to slanted surface 27 of cam slide 26, which in turn causes holding block 20 to move in direction A, towards the cylinder 2, with respect to the housing 22, so that greater deformation of the cord 15 in that area takes place.

The actuator 37 is periodically actuated to move the cleaning means 6 away from cylinder 2 at which time the cord 15 is inspected. If fins 40 have set in a face 39 of the cord, so that the cord has the general configuration illustrated by reference numeral 15' in FIG. 5, then it is known that it is time to replace the cord. The operator merely grasps the cord with his/her fingers, or with forceps, pliers or the like, and with an outward force strips the cord from the channels 24. Then a new cord 15 is force fit into the channels 24 and the cleaning means 6 is ready for reuse.

It will thus be seen that according to the present invention a simple, cost effective, and efficient cleaning apparatus and method have been provided for association with a grooved applicator for applying molten size to spun yarn and the like. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and methods.

What is claimed is:

1. Apparatus for applying sizing material to a plurality of textile strands, comprising:

an applicator cylinder having a grooved exterior circumferential surface and mounted for rotation about a first axis;

means for applying melted sizing material to said cylinder so that size lodges in said grooves thereof;

means for rotating said cylinder about said first axis so that size in said grooves is applied to the textile strands each moving past said cylinder and traveling for at least a short distance in a groove; and means for cleaning the grooves in said grooved cylinder by wiping material that collects in said grooves from said grooves, said cleaning means comprising: a cord of elastomeric material elongated in a first dimension; and means for holding said cord into contact with said cylinder so that the cord is forced into the grooves of said cylinder with the cord elongated in a dimension generally parallel to said first axis, the cord deforming into the grooves so as to effect cleaning of sizing material from the grooves, said holding means comprising: a plurality of holding blocks each having a first end thereof and means defining a channel in said first end for receiving said cord, and means for individually adjusting the positions of said blocks with respect to a housing; each of said holding blocks being linearly reciprocally mounted for sliding movement with respect to the housing, and said means for adjusting the position of each of said holding blocks comprising, for each holding block, a cam slide engaging said holding block at a surface thereof opposite said quadrate channel, and including a slanted surface portion, and an adjustment screw operatively engaging said slanted portion.

2. Apparatus as recited in claim 1 wherein said housing includes a hold down strip overlying said holding blocks, and fastener means for attaching said hold down strip to the rest of said housing to provide a clamping force for holding said holding blocks in place with respect to said housing; and wherein said housing is beveled so as to facilitate flow of sizing material thereover.

3. Apparatus comprising:

a housing;

a plurality of holding blocks mounted by said housing and for linear slidable movement with respect to said housing;

individual adjustment means for adjusting the position of each of said blocks with respect to said housing;

each block having a first end thereof, extending outwardly from said housing means defining an elongated channel, the channels of adjacent holding blocks being generally in alignment; and an elongated cord of elastomeric material generally circular in cross-section, and disposed within said block channels and extending outwardly from said blocks;

each of said holding blocks being linearly reciprocally mounted for sliding movement with respect to said housing, and said means for adjusting the position of each of said holding blocks comprising, for each holding block, a cam slide engaging said holding block at a surface thereof opposite said quadrate channel, and including a slanted surface portion, and an adjustment screw operatively engaging said slanted portion.

4. Apparatus as recited in claim 3 wherein said housing includes a hold down strip overlying said holding blocks, and fastener means for attaching said hold down strip to the rest of said housing to provide a clamping force for holding said holding blocks in place with respect to said housing.

* * * * *